US012256878B2

(12) United States Patent
Passafiume

(10) Patent No.: US 12,256,878 B2
(45) Date of Patent: Mar. 25, 2025

(54) PAINTING AND CLEANING MULTI-TOOL

(71) Applicant: Frank Passafiume, North Olmsted, OH (US)

(72) Inventor: Frank Passafiume, North Olmsted, OH (US)

( * ) Notice: Subject to any disclaimer, the term of this patent is extended or adjusted under 35 U.S.C. 154(b) by 380 days.

(21) Appl. No.: 17/820,562

(22) Filed: Aug. 17, 2022

(65) Prior Publication Data

US 2023/0054573 A1 Feb. 23, 2023

Related U.S. Application Data

(60) Provisional application No. 63/234,371, filed on Aug. 18, 2021.

(51) Int. Cl.

| | |
|---|---|
| ***A47L 13/16*** | (2006.01) |
| ***A47L 13/38*** | (2006.01) |
| ***A47L 13/44*** | (2006.01) |

(52) U.S. Cl.

CPC ..... *A47L 13/16* (2013.01); *A47L 13/38* (2013.01); *A47L 13/44* (2013.01)

(58) Field of Classification Search

CPC ..... A47L 13/16; A47L 13/10; A47L 13/20; A47L 13/38; A47L 13/44; A47L 25/00; B05C 17/02; B05C 17/10; B05C 17/00; B05C 21/00; B08B 11/02

USPC ..... 15/159.1–160, 220.3, 229.1, 229.4, 231; 138/155

See application file for complete search history.

(56) References Cited

U.S. PATENT DOCUMENTS 3,528,076 A * 9/1970 Anderson ..... A47L 13/254 15/228

7,650,664 B2 * 1/2010 Henderson ..... A47L 13/46 15/210.1

* cited by examiner

*Primary Examiner* — Eric J Rosen

*Assistant Examiner* — Sharonda T Felton

(74) *Attorney, Agent, or Firm* — Kathryn Perales

(57) ABSTRACT

This cleaning tool has a shape that includes an angle, a flat bottom surface and rounded front protuberances, and can be attached to any pole, either directly at the cleaning tool's receiving opening, or using the provided adaptor between the cleaning tool and pole. The cleaning tool is covered with a washable and removable microfiber sock, or a sanding or scrubbing pad is attached to hook material on the flat side of the tool. When the cleaning tool is attached to the opposite end of a painter's pole from the paint roller, a painter can seamlessly paint and clean errant drips without switching tools, by reversing the assembly.

20 Claims, 8 Drawing Sheets

PAINTING AND CLEANING MULTI-TOOL

BACKGROUND OF THE INVENTION

When performing a wall painting project, a painter must reach for high and low areas to sand, clean, and paint. To work on portions of a wall that are higher than arm's length reach, painters commonly use an extension pole with an attached tool, or climb up a ladder to get close enough to reach the high portion with a hand-held tool or rag. Moving a ladder to an appropriate location, and climbing up and down, over and over, is a cumbersome task which adds time, effort and risk of accidents and injuries to the job. To work on low portions of a wall, painters commonly use an extension pole with an attached tool, or bend, kneel or crouch down in order to reach the low portion with a hand-held tool or rag. Bending, kneeling or crouching repeatedly, and for long periods of time, is fatiguing and hard on the body.

Even expert painters may make unwanted paint spots or smudges when painting at the ceiling line or floor line, and these mishaps may be rectified easily and cleanly only if addressed immediately. The inconvenience of setting aside the painting tool, finding a rag, returning to and rubbing the spot, setting aside the rag, and retrieving the painting tool each time is annoying and inefficient. A solution is needed to facilitate timely reaching and cleaning areas that may be difficult or inconvenient to reach, while minimizing slowdowns in the painter's workflow.

BRIEF DESCRIPTION OF THE INVENTION

This disclosure relates to a painting and cleaning assembly. More particularly, the present disclosure relates to a cleaning tool that can attach to an extension pole that is used for painting.

The foregoing and other features of the disclosure are hereinafter more fully described below, the following description setting forth in detail certain illustrative embodiments, these being indicative, however, of but a few of the various ways in which the principles of the present disclosure may be employed.

The cleaning tool herein described is shaped and sized to effectively clean and sand small areas on walls, ceilings or floors, along edges and in corners. The cleaning tool ("tool") is large enough to wipe away paint smudges and drips of a size commonly experienced by a painter, and also small enough to avoid being heavy, in the way or unwieldy when it is attached to the end of an extension pole opposite to the paint roller end. The front end of the tool is rounded rather than sharp, and includes two protuberances which are also rounded and resemble animal ears. The ears effectively guide and push the sock-covered tool into the cornice area along the ceiling line or close to the floor line, and into corners.

The tool is angled appropriately so that it may be conveniently and effectively used to rub a surface when attached to a pole. The receiving opening on the tool is sized appropriately and constructed of a material so that with a slight to firm push together by hand, it receives a standard painter's extension pole and stays firmly connected until pulled apart by hand. Alternatively, an adaptor can be placed into the receiving opening on the tool, which enables the tool to receive a broomstick or other available pole or rod which has a smaller diameter than a painter's pole, and to stay together with the same level of soundness. The receiving opening also incorporates an axial groove which acts as a pressure release mechanism, making it easier to attach and detach a pole.

For ease of use and convenience, the tool is easily and quickly attachable to and detachable from a pole by hand, and does not come loose or fall off the pole accidentally. The user may keep the tool attached to a pole, or take it on and off at will. The user may choose to use the tool without a pole, for tasks that are reachable within arm's length.

The tool requires a replaceable covering to provide utility, such as a sanding pad or a sock with microfiber mop piles or strands. The flat underside surface of the tool is covered with a layer of hook material, which may receive an appropriately sized and shaped cleaning or sanding pad which has loop material on its backing. The hook material also serves to lightly grip the inside of a sock which can be slipped onto the tool, covering the tool. The sock has microfiber mop strands or piles extending from the outer surface of the part of the sock which contacts the flat end of the tool. When rubbed on a wall, these microfiber mop strands effectively clean and remove paint smudges and drips, as well as dirt, dust and cobwebs.

DETAILED DESCRIPTION

Figure 1:
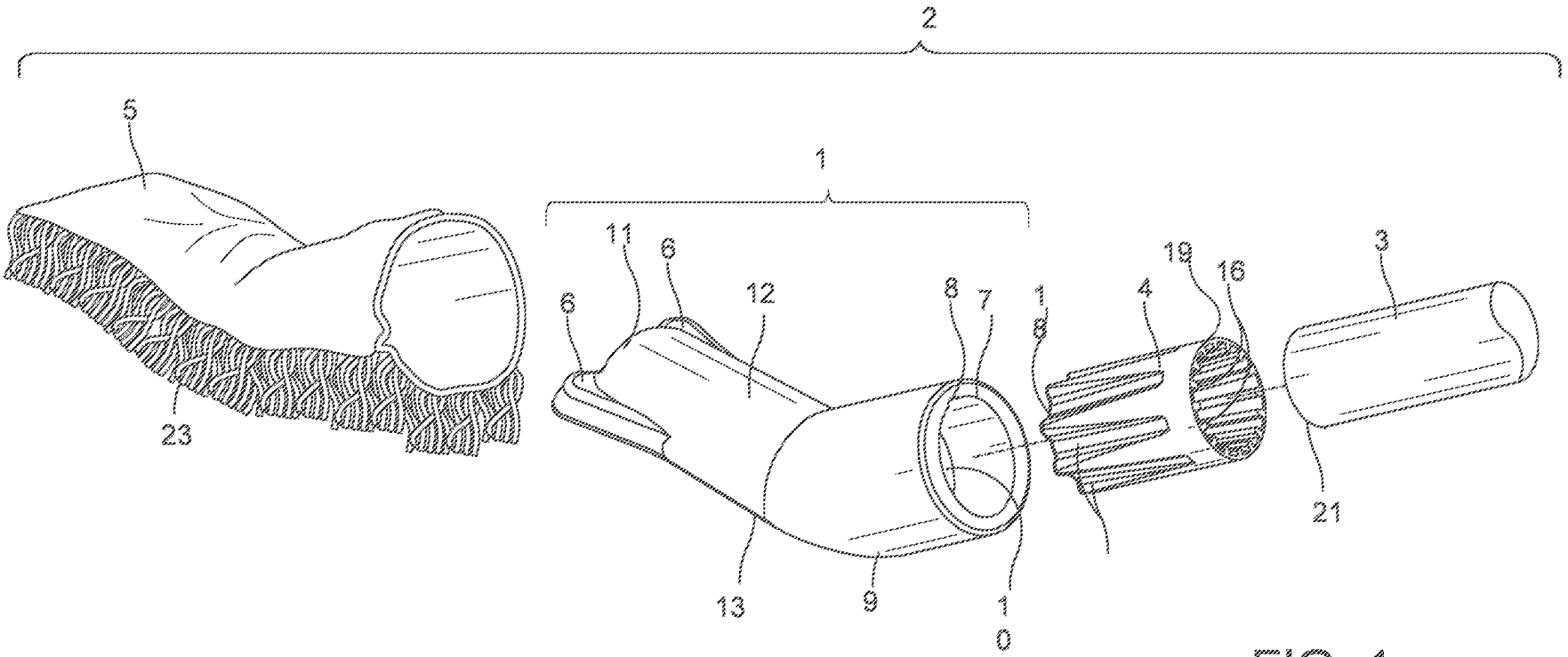
FIG. 1 is a perspective exploded view of the cleaning assembly, including sock, tool, adaptor and pole.
Figure 2:
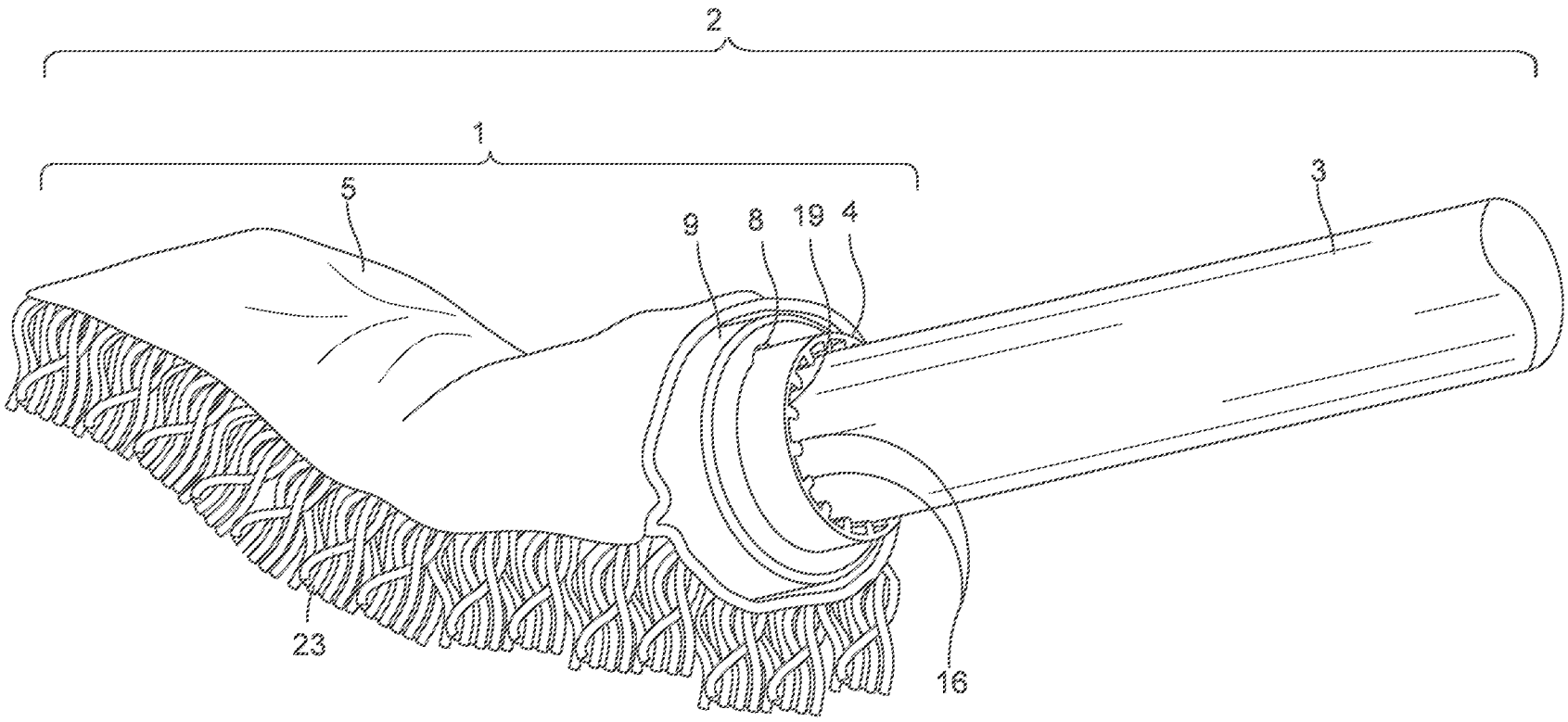
FIG. 2 is a perspective side view of the assembly, including the adaptor.
Figure 3:
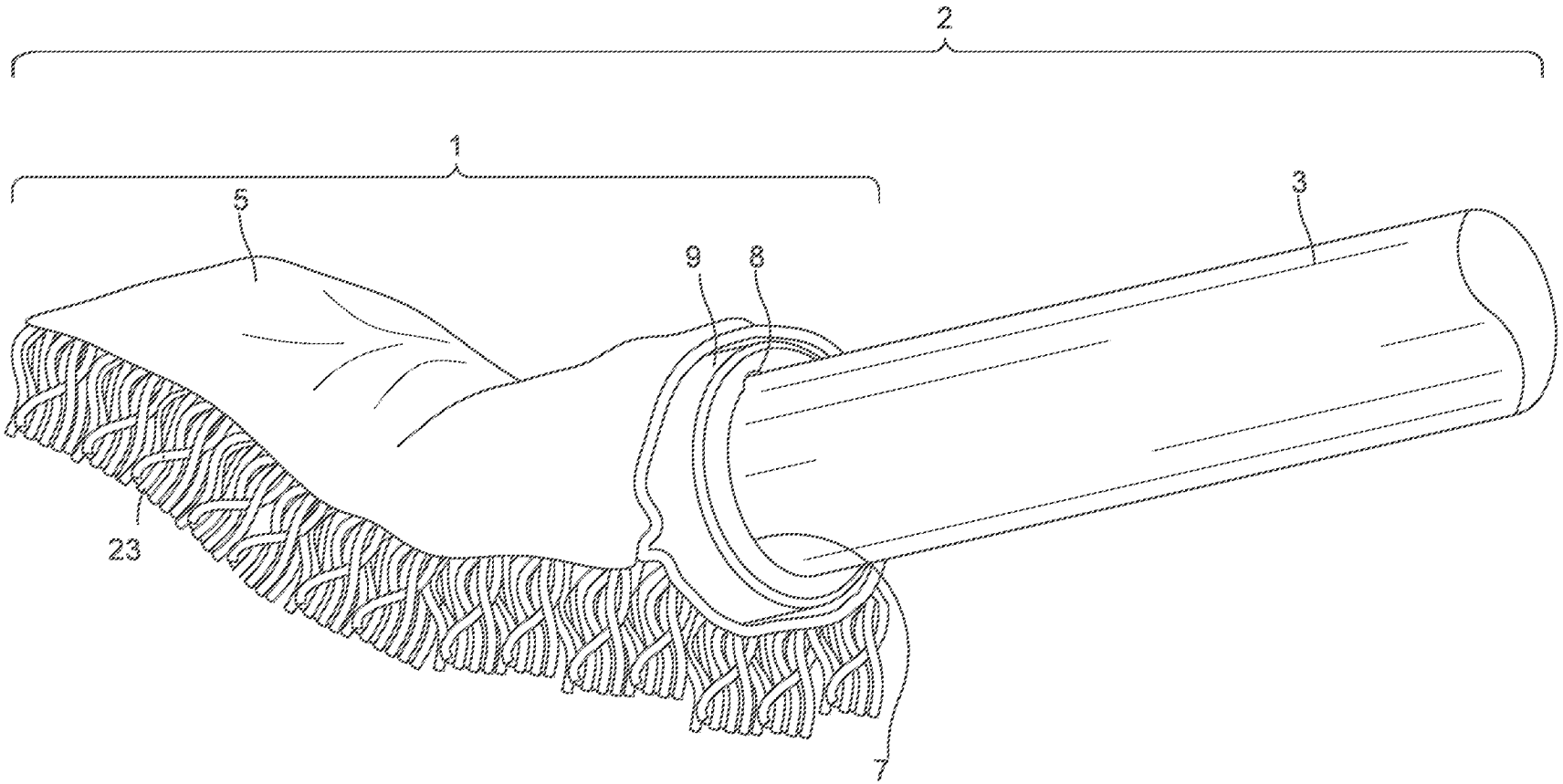
FIG. 3 is a perspective side view of the assembly, not including the adaptor.
Figure 4:
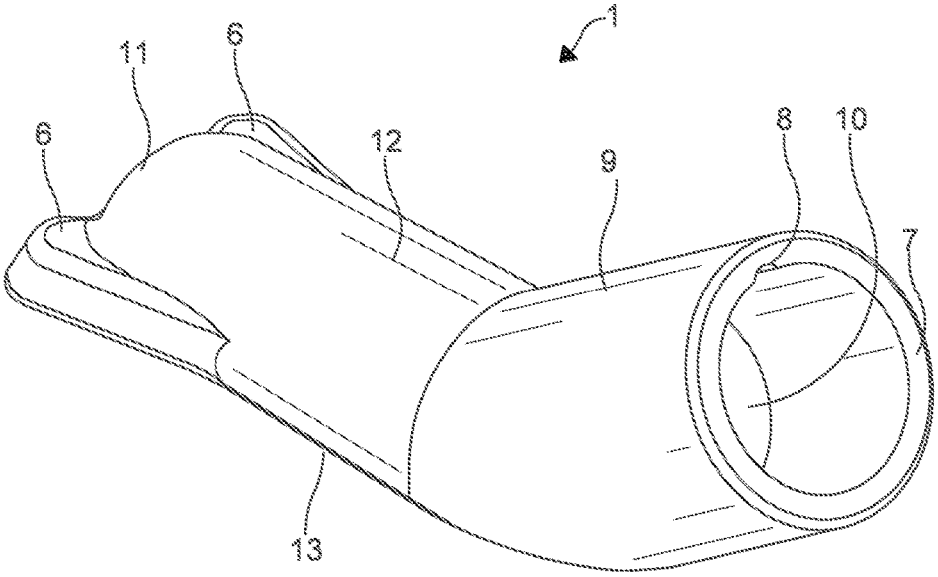
FIG. 4 is a perspective side view of the cleaning tool.

FIGS. 1, 2 and 3 show a painting and cleaning assembly 2. The embodiment shown of the assembly 2 includes a rod or pole 3, a cleaning tool 1 and a sock 5, which is a covering for the tool 1. The assembly may also include an adaptor 4 placed between the pole 3 and the tool 1, as shown in FIGS. 1 and 2, or certain poles may fit into the receiving opening 7 of the tool 1 sufficiently closely that the adaptor 4 is not needed for the assembly 2, as shown in FIG. 3.

Figure 14:
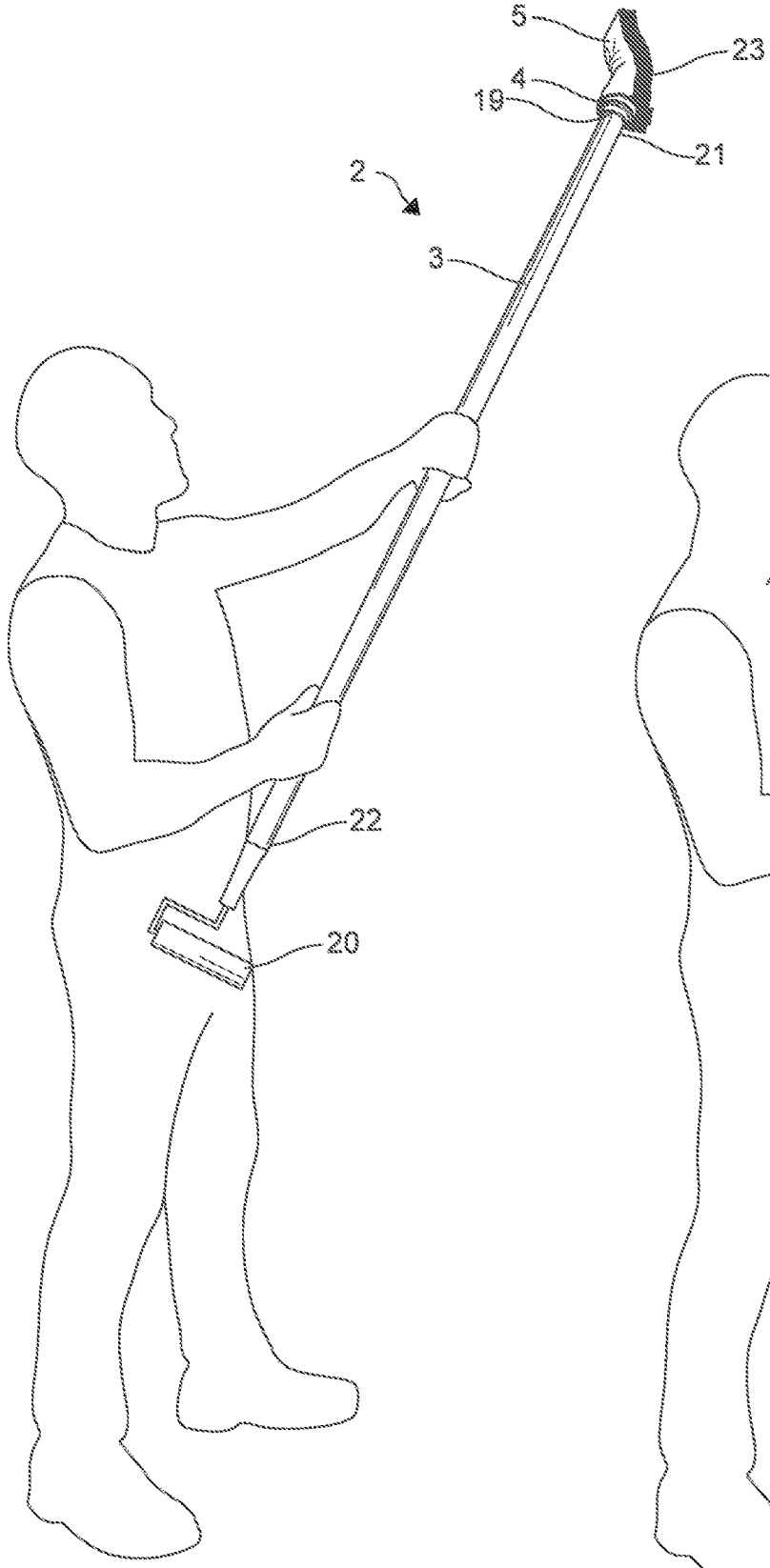
FIG. 14 is a perspective view of the assembly, including sock, cleaning tool, adaptor, pole and additional tool (paint roller), in use by a person.

The pole 3 may have an additional tool 20 as shown in FIG. 14, attached to the painting end 22 of the pole 3 opposite to the cleaning tool 1. The additional tool 20 may be a broom head, painting implement or other useful attachable item. This preferred embodiment of the painting and cleaning assembly 2 allows a user to paint a surface with the additional tool/painting implement 20 end, and also clean an area with the cleaning tool 1 end, with a single device without downtime. More particularly, the assembly 2 allows the user to seamlessly transition between painting and cleaning without having to switch devices. Rather, the user can merely use the opposite ends of the assembly 2 as will be described in more detail hereinafter.

The pole 3 may be a rod, and it may also be an extension pole, and it extends between a tool end 21 that can be configured for attachment to the cleaning tool 1 and a painting end 22 that can be configured for attachment to the additional tool/painting implement 20. In traditional devices, the tool end 21 of the pole 3 would only be used for holding onto the pole 3 by the user. Further, it will be appreciated that the term "extension" indicates that a distance between the tool end 21 and the painting end 22 can be varied, thereby allowing a user to increase or decrease an overall length of the pole 3.

As previously indicated, the user can attach the additional tool/painting implement 20 to the painting end 22 of the pole 3, or the additional tool 20 may already be permanently attached to the painting end 22 of the pole 3. Typically, the additional tool/painting implement 20 could include a paint roller, a paint brush, or a paint pad. However, other additional tools are envisioned and contemplated. For example, the additional tool 20 could be a plaster stamper, sanding pad or broom head without departing from the scope of this disclosure. Generally, the additional tool 20 is threadingly attached to the painting end 22 of the pole 3 for secure engagement.

With reference to FIGS. 4-8, the cleaning tool 1 is shown. The cleaning tool 1 has two main portions: a cylindrical back portion 9 with a receiving opening 7 for the pole 3 or adaptor 4 and pole 3, and a generally semi-cylindrical front portion 12 with the flat side on the bottom 13, a roughly semihemispherical front end 11 plus two protuberances 6 extending diagonally forward and outward on either side of the front end 11. The two protuberances 6 resemble animal ears when viewed from the top as in FIG. 6, and mirror each other on either side of the front end 11. The bottom surface of each ear 6 is flat and planar with the remainder of the bottom surface 13 of the front portion of the tool 1. In a preferred embodiment, each ear 6 is shaped similarly to part of a triangular prism sticking out of either side of the front end 11, with rounded edges and the bases facing up and down, the bottom base of each triangular prism being slightly larger than the top base.

Figure 5:
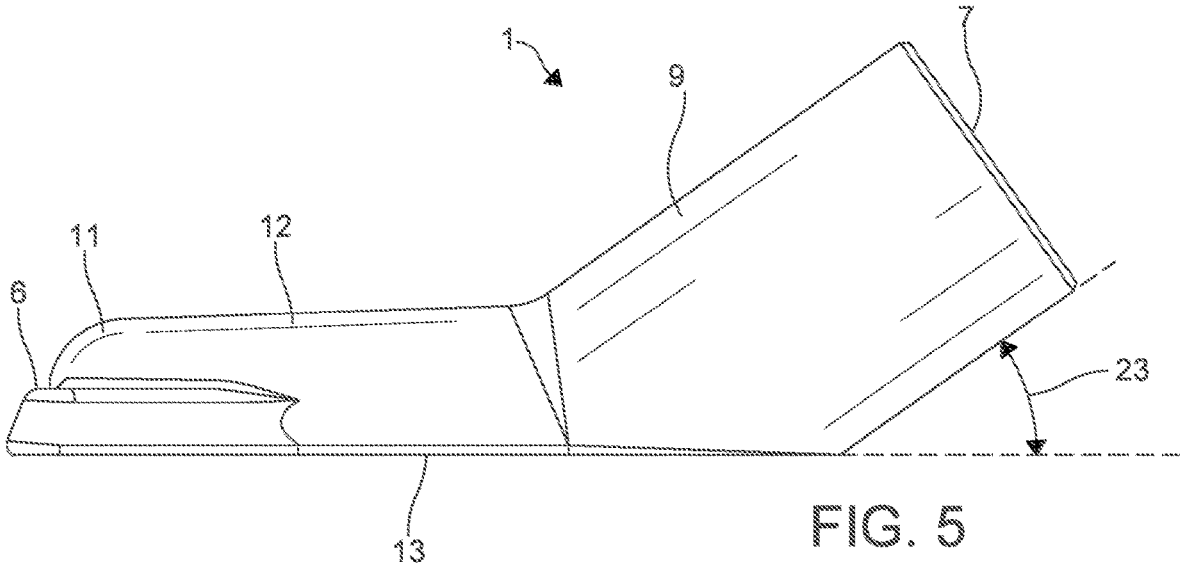
FIG. 5 is a side elevation view of the cleaning tool.
Figure 6:
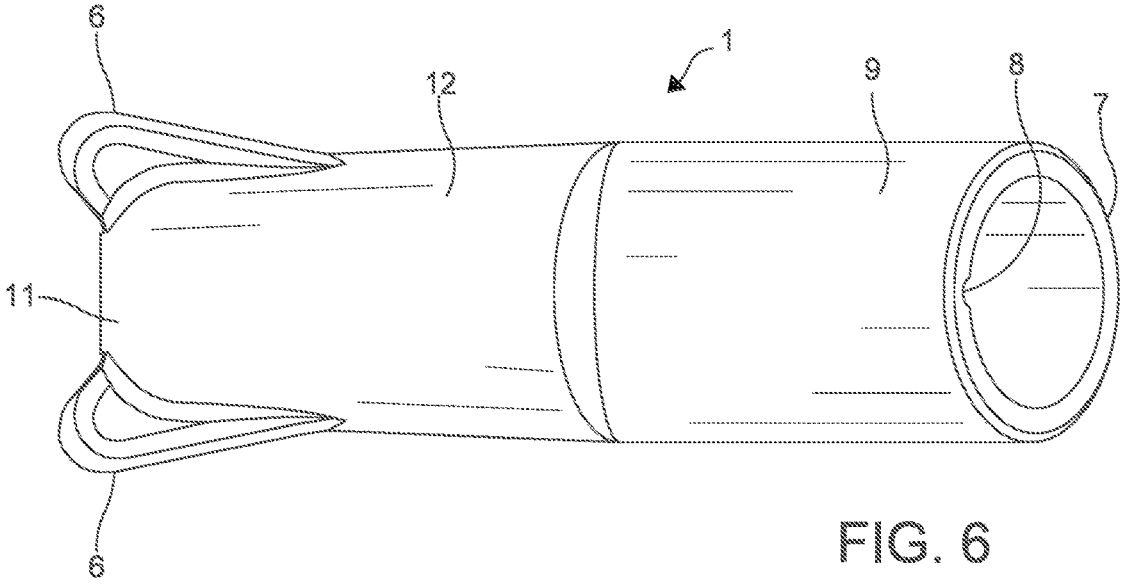
FIG. 6 is a top view of the cleaning tool.

The axis of the semi-cylindrical front portion 12 and the axis of the cylindrical back portion 9 are angled in relation to each other, such that when the flat bottom 13 rests on a table or floor, the back portion 9 is angled upwards with an acute angle between the axis of the back portion 9 and the axial line extending behind the semi-cylindrical front portion 12, as shown in FIG. 5. Multiple angles were prototyped and tested, and angles between 25° and 55° were found to be useful. In a preferred embodiment, a 35° angle was found to be most effective for cleaning, sanding and other uses.

Edges of the front portion 11, 12 and ears 6 are rounded, rather than being sharp. Sharp edges may cut or poke through a sock covering 5, and rounded edges were found to be effective for cleaning and effectively rubbing the sock material into corners and along cornice areas and floor lines. The front ends of the two ears 6 reach slightly further forward than the semihemispherical front end 11; the resulting shape has been found to be preferable to alternate shapes, for cleaning and effectively rubbing the sock material into corners and along cornice areas and floor lines.

The front portion 11, 12 and ears 6 may be solid or hollow, so long as the structure of the tool 1 is strong and sturdy enough to keep its shape and strength while in use. The method of manufacture may dictate whether the interior of the front end 6, 11, 12 is solid, or contains holes or cavities or some pattern including empty space. In a preferred embodiment, the entire tool 1 is made of polypropylene, using an injection molding technique. In this preferred embodiment, the injection molding process requires that the interior of the front portion 12 not be completely solid, so that the tool will harden properly and retain its shape and strength.

A tool 1 made of wood, for example, could be solid. A tool 1 made with an additive manufacturing technique might be solid, or may have any interior structure which adequately creates, supports and retains the desired outer shape.

In a preferred embodiment, the entire cleaning tool 1 is of unitary construction, and one uniform material. The tool 1 could also be made of a plurality of components, all being attached together and combined to make a tool 1 with the shape described herein. The components could be made of the same or different types of material, or the same type of material with varying properties.

In a preferred embodiment, the tool 1 is 7.11 inches long (measured along the axis of the semicylinder 12,) 2 inches wide measured at the semicylinder 12 or cylinder 9 portions, 2.42 inches wide measured at the widest part of the ears 6, and 2.74 inches high, when resting on its flat bottom surface 13.

Figure 8:
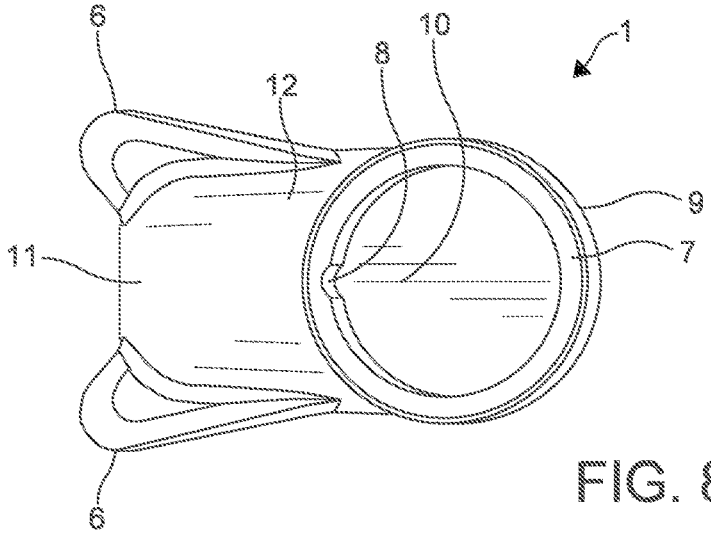
FIG. 8 is a view of the cleaning tool from the back.

The receiving opening 7 in the cylindrical back portion 9 of the tool 1 is also cylindrically shaped, as shown in FIG. 8, and the receiving opening 7 extends down into the back portion 9 to a flat base or wall 10 which is roughly parallel to the circumference of the lip of the opening 7. An axial rounded groove 8 is cut into the interior surface of the receiving opening 7, and extends from the lip of the opening 7 all the way down to the wall 10 at the bottom of the opening. This groove 8 acts as a pressure release mechanism, making it easier to insert and remove the pole 3 and/or adaptor 4 into or from the receiving opening 7.

Figure 7:
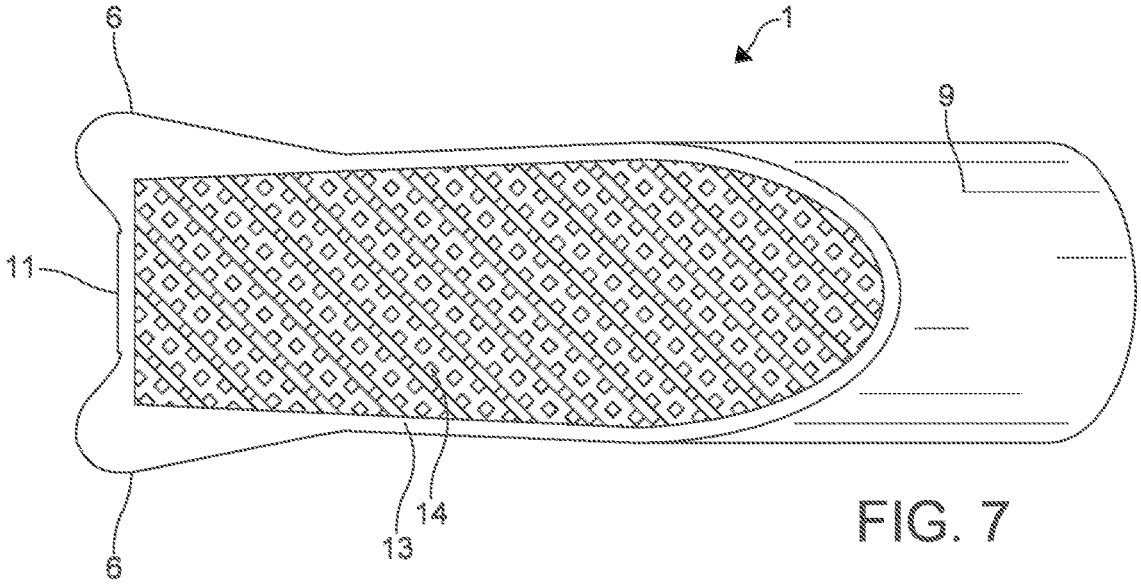
FIG. 7 is a bottom view of the cleaning tool.
Figure 12:
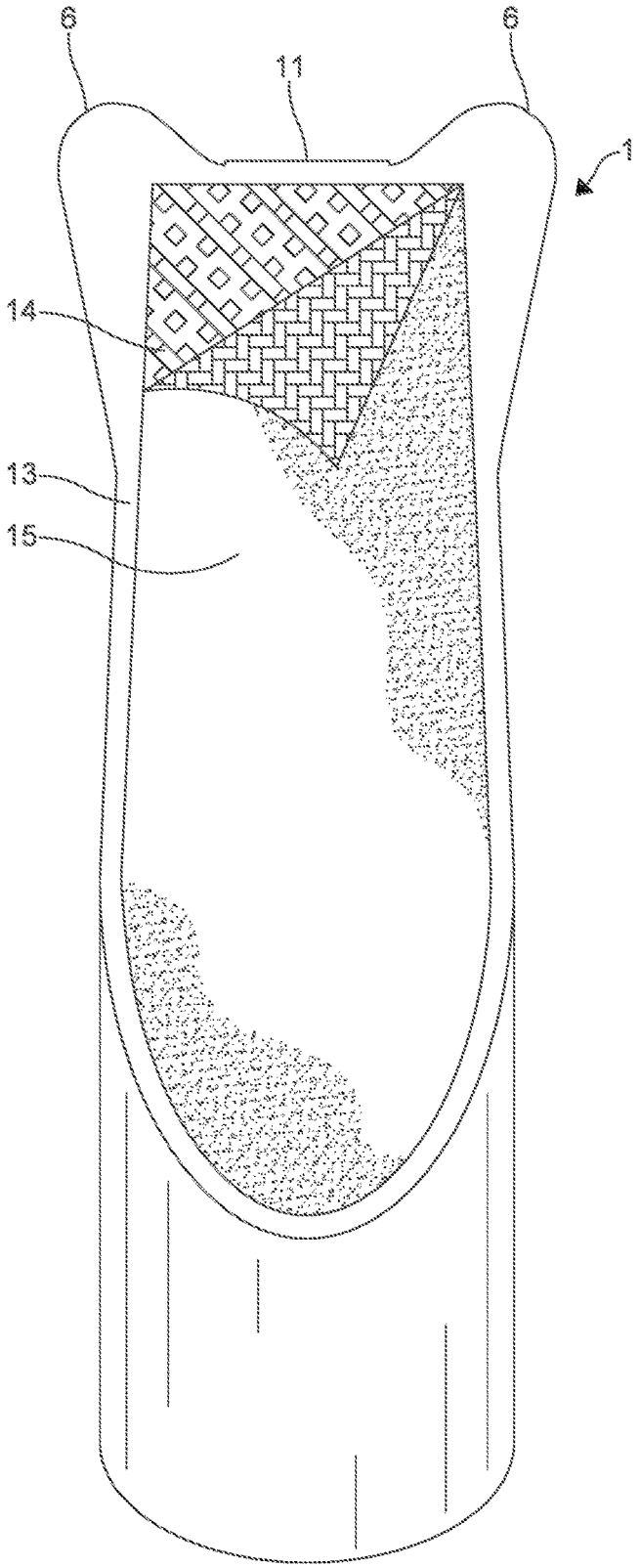
FIG. 12 is a bottom view of the cleaning tool with a sanding pad partially attached and partially folded back.
Figure 13:
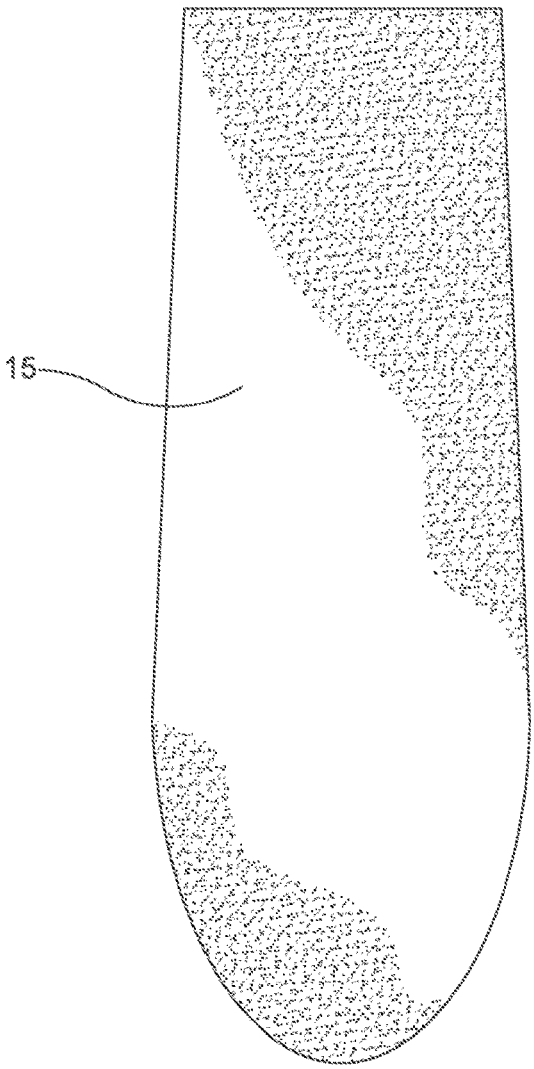
FIG. 13 is a view of the sanding surface of a sanding pad.

The bottom side 13 of the tool 1, as shown in FIG. 12, is substantially covered with a layer of hook material 14, as shown in FIG. 7. The shape of the hook material layer 14 may extend exactly to the edges of the bottom surface 13 and ears 6, or it may have a more regular shape, as shown in FIGS. 7 and 12. A sanding pad 15 with a backing of loop material may match the hook material 14 exactly in size and shape, as shown in FIGS. 12 and 13, or it may vary in shape and size, depending upon what is available and the preference of the user.

A removable and washable sock 5 is provided. The word "sock," when used herein, is meant to refer to the general shape of the object, and how the manner of installation and removal of the sock 5 described herein onto the cleaning tool 1 is very similar to how a sock is usually pulled onto and off of a person's foot. The "sock" described and referred to in this disclosure herein is not meant to suggest an actual intended use of covering a person's foot.

In a preferred embodiment, the sock 5 is sized and shaped to be pulled onto and snugly cover the entire tool 1, leaving an opening at the receiving opening 7. The sock 5 could also be configured to cover less of the tool 1, for example partially cover the top surface of the tool 1, but will normally cover the bottom 13 of the tool 1 completely. In a preferred embodiment, at least the bottom outer surface of the sock 5 includes a layer of microfiber mop-like piles 23 which extend outward, as shown in FIGS. 1, 2 and 3, and which may be looped or cut. The outer surface of the part of the sock 5 that covers the top 12 of the tool 1 will normally not be used for cleaning, and may be made of any type of fabric or netting, including more microfiber piles. Alternatively, the bottom outer surface of the sock 5 may be made of or covered with microfiber material without piles, or another material as desired for cleaning, scrubbing, sanding, or even applying paint or another substance such as cleaning fluid or water.

In a preferred embodiment, the inner surface of the sock 5 which contacts the hook layer 14 on the cleaning tool does not include a layer of loop material. The hook layer 14 grabs the inner surface fabric of the sock 5 well enough to keep the sock 5 in place. The grip between the sock 5 and the hook layer 14 does not make it difficult to remove the sock 5. A loop layer inside the sock 5 is undesirable, as it may make removal of the sock 5 quite difficult.

In a preferred embodiment, the inner diameter of the receiving opening 7 is 1.551 inches. This diameter is appropriate to receive a standard painter's pole, so that when pushed together by hand, the tool 1 and painter's pole 3 stay sturdily connected until purposely pulled apart by hand.

Figure 9:
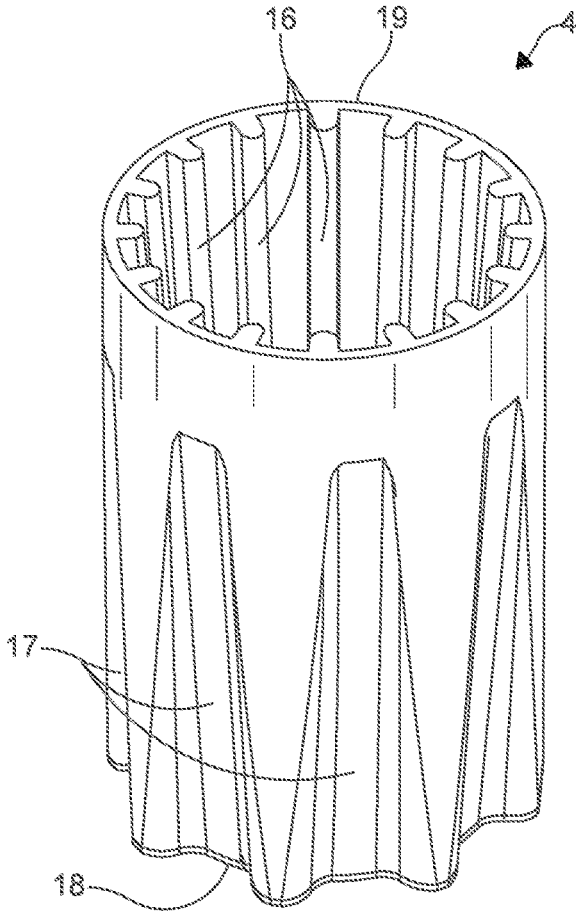
FIG. 9 is a side perspective view of the adaptor.
Figure 10:
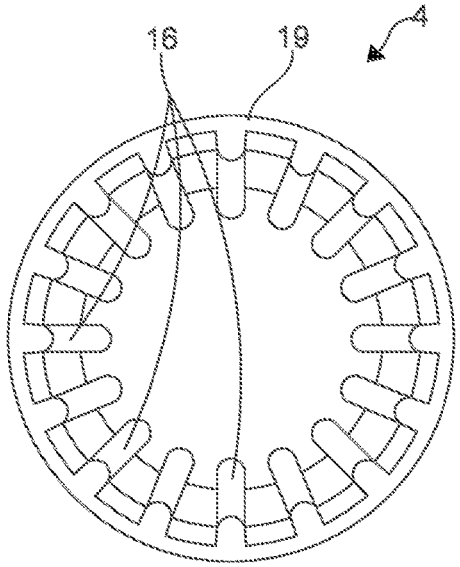
FIG. 10 is a view of the adaptor from the top or pole end.
Figure 11:
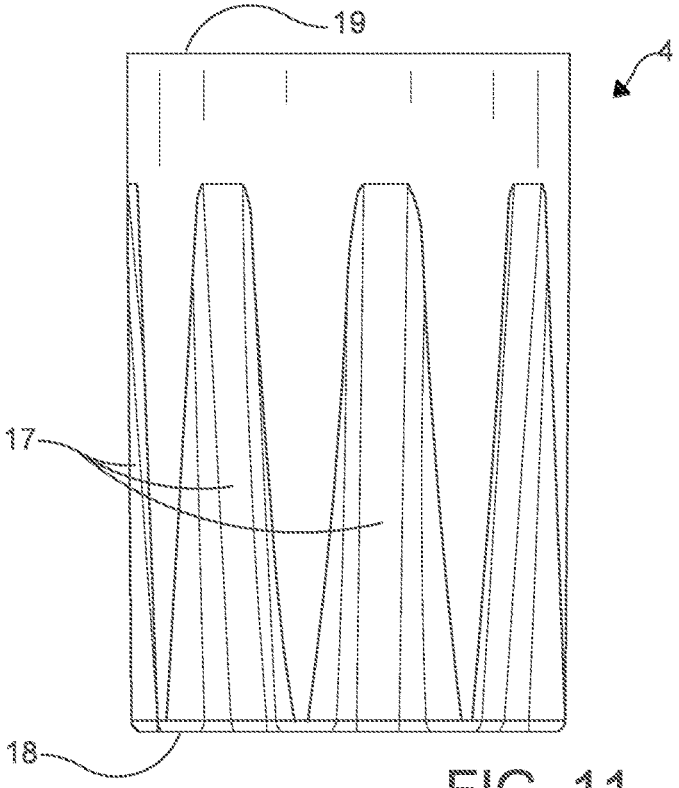
FIG. 11 is a side elevation view of the adaptor.

An adaptor 4 is provided which allows poles and rods of smaller diameters, like a household broomstick, to be easily attached to the tool 1 using hand pressure. The adaptor 4, shown in FIGS. 9-11, is generally tubular, and its outer diameter is uniform along its entire length. Straight axial ridges 16 extend along the inner surface of the adaptor 4 at regular intervals. The adaptor has a pole end 19 and a tool end 18. The inner diameter of the adaptor 4 is greater at the pole end 19, and the opening tapers down and the inner diameter decreases constantly from the pole end 19 to the tool end 18. As a result, the interior axial ridges 16 are closer together at the tool end 18 than at the pole end 19.

In a preferred embodiment shown in FIGS. 9 and 11, the outer surface of the adaptor 4 is flat and smooth at the pole end 19. Moving from the pole end 19 toward the tool end 18, the outer surface 17 gradually becomes ridged, with two groups of regularly alternating sections resembling truncated triangles. The first group of regular alternating sections have outer-most surfaces that, if joined into an imaginary circle, retain a constant outer diameter from the pole end 19 to the tool end 18 of the adaptor 4. The outermost surfaces of the sections of the first group are generally shaped like isosceles triangles, with the base located near the pole end 19, and the truncated vertex angle located at the tool end 18. The second group of regular alternating sections gradually indent, becoming deeper as they approach the tool end 18, and an imaginary circle joining the outer-most surfaces of these depressed sections gradually decreases in diameter, as shown in FIGS. 1 and 8. The outer surfaces of the sections of the second group are also generally shaped like isosceles triangles, but reversed—each base is located at the tool end 18, and each truncated vertex angle is near the pole end 19.

In a preferred embodiment, the inner diameter of the adaptor 4 at the tool end 18 is 0.81 inches, and the outer diameter of the adaptor 4 at both ends is 1.48 inches. In a preferred embodiment, the inner surface 16 of the adaptor 4 has 16 axial ridges. In a preferred embodiment, the outer surface 17 of the adaptor has 8 pairs of alternating sections, and the alternating sections extend from the tool end 18 to a circumferential group of points which is approximately 19% of the adaptor's height away from the pole end 19.

The adaptor 4 should have some level of flexibility and deformability, which properties allow plastic radial deformation and improve the adaptor's grip on the tool 1 and the pole or rod 3. In a preferred embodiment, the adaptor 4 is made of TPV (thermoplastic vulcanizate) material.

In a preferred embodiment, and as shown in FIGS. 1 and 3, the adaptor 4 is removable. It will be appreciated that the adaptor 4 could be integral with the tool 1 without departing from the scope of the disclosure.

Figure 15:
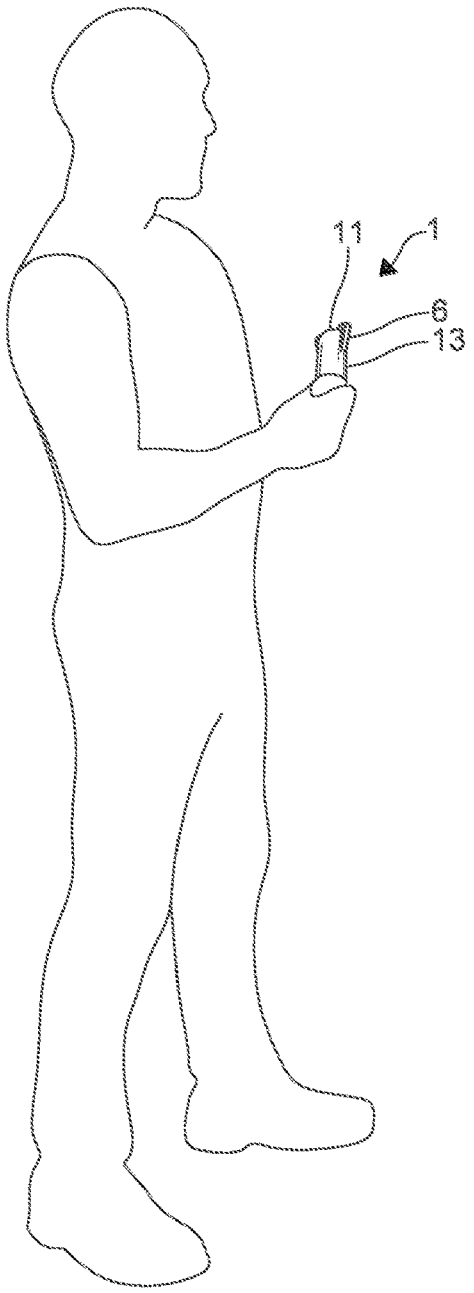
FIG. 15 is a perspective view of the handheld cleaning tool, in use by a person.

Operation of the tool 1 and several embodiments of the assembly 2 will now be discussed. If a user wishes to use the cleaning tool 1 to work on a surface within arm's length, then a sock 5 can be slid onto the tool 1, or an appropriate pad 15 attached to the hook layer 14 of the tool 1, and then the assembly 2 is ready for use. To clean or sand, the user grips the cylindrical back portion 9 of the tool 1 with the user's hand, similar to a tennis racket grip, and rubs a surface with the covered flat bottom side 13 of the tool 1, as shown in FIG. 15. The sock 5 or cleaning pad can apply cleaning solution to the surface, and/or remove foreign bodies, which may include dust, dirt, cobwebs, grease, or undesirable wet paint.

If a user wishes to use the tool 1 with a pole 3 that fits snugly into the receiving opening 7, such as a standard painter's pole, then the user simply inserts the tool end 21 of the pole 3 into the receiving opening 7. If a user wishes to use the tool 1 with a pole 3 that has a smaller diameter, then the user inserts the adaptor 4, tool end 18 first, into the receiving opening 7, and then inserts the tool end 21 of the pole 3 into the pole end 19 of the adaptor 4. The pole 3 may already have a painting implement or other additional tool 20 attached to its painting end 22, as shown in FIG. 14, or the user can attach a painting implement or other additional tool 20, threadingly or otherwise, or the user may elect not to have any additional tool attached to the painting end 22 of the pole 3.

Once the pole assembly 2 is complete (covering, tool, optional adaptor, pole and optional additional tool), it can be used to clean and sand surfaces which are within reach of the combined length of the user's arms and the length of the pole 3. If a painting implement 20 is included, then the assembly 2 can be seamlessly utilized to paint surfaces, while also having the ability to clean surfaces without setting the assembly 2 on the ground or requiring further adjustments.

A painting and cleaning multi-tool has been described above with particularity. Modifications and alterations will occur to those upon reading and understanding the preceding detailed description. The disclosure, however, is not limited to only the embodiments described above. Instead, the disclosure is broadly defined by the appended claims and the equivalents thereof.

Moreover, it will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the claims.

What is claimed is:

1. A painting and cleaning assembly, comprising a cleaning tool and a removable covering, wherein:

said cleaning tool comprises a cylindrical back portion having an axis and a receiving opening; and a front portion having a generally semicylindrical shape, with an axis and a flat planar bottom surface, and two protuberances having a generally triangular prism shape; and said front portion's flat bottom surface is partially covered with hook material; and said two protuberances share the flat planar bottom surface of the remainder of the said front portion, and extend diagonally forward and outward from either side of the said front portion; and said removable covering covers at least the said hook material of the cleaning tool's bottom surface; and wherein the said axis of the said cylindrical back portion of the cleaning tool, as it extends upward, forms an angle with the said front portion's axis, as the front portion's axis extends behind the tool, and the said angle is between 25 and 55 degrees.

2. The painting and cleaning assembly of claim 1, further comprising a pole which has a first end and a second end, wherein said receiving opening of said cleaning tool is configured to removably attach to the first end of the pole using hand pressure.

3. The painting and cleaning assembly of claim 1, further comprising a tubular adaptor with a first end, a second end, an inner surface and an outer surface; and wherein said adaptor's first end is configured to removably fit inside the said receiving opening, and said adaptor's second end is configured to firmly receive the said pole's first end; and wherein said cleaning tool, adaptor and pole are configured to removably attach together using hand pressure; and wherein the said inner surface of said adaptor comprises uniformly spaced axial ridges which extend from said adaptor's said first end to its said second end; and wherein the said adaptor's first and second ends each have an inner diameter and an outer diameter; and wherein the said outer diameters of the adaptor's first and second ends are equal; and wherein the said inner diameter of the adaptor's first end is greater than the said inner diameter of the adaptor's second end, such that the inner surface of the adaptor is tapered.

4. The painting and cleaning assembly of claim 2, further comprising:

a painting implement configured to be attached to the said second end of the said pole;

wherein either of the said cleaning tool and said painting implement can be usefully employed by reversing the orientation of said painting and cleaning assembly, without further adjustment or modification to said assembly.

5. The painting and cleaning assembly of claim 3, further comprising:

a painting implement configured to be attached to the said second end of the said pole;

wherein either of the said cleaning tool and said painting implement can be usefully employed by reversing the orientation of said painting and cleaning assembly, without further adjustment or modification to said assembly.

6. The painting and cleaning assembly of claim 2, further comprising:

an additional tool configured to be attached to the said second end of the said pole;

wherein either of the said cleaning tool and said additional tool can be usefully employed by reversing the orientation of said painting and cleaning assembly, without further adjustment or modification to said assembly.

7. The painting and cleaning assembly of claim 3, further comprising:

an additional tool configured to be attached to the said second end of the said pole;

wherein either of the said cleaning tool and said additional tool can be usefully employed by reversing the orientation of said painting and cleaning assembly, without further adjustment or modification to said assembly.

8. The painting and cleaning assembly of claim 1, wherein said angle is 35 degrees.

9. The painting and cleaning assembly of claim 1, wherein said removable covering comprises a sanding pad with a sanding surface and an attachment surface, and wherein said attachment surface comprises a layer of loop material.

10. The painting and cleaning assembly of claim 1, wherein said removable covering comprises a sock-like fabric covering with an inner surface and an outer surface, and wherein the outer surface of the portion of said fabric covering which contacts and covers the said bottom surface of said cleaning tool comprises a plurality of piles.

11. The painting and cleaning assembly of claim 10, wherein said plurality of piles are made of microfiber yarn or strings.

12. The painting and cleaning assembly of claim 10, wherein said plurality of piles are looped.

13. The painting and cleaning assembly of claim 10, wherein said plurality of piles are cut.

14. The painting and cleaning assembly of claim 3, wherein said adaptor is made of TPV (thermoplastic vulcanizate).

15. A method of assembling a painting and cleaning multi-tool, comprising the steps of:

selecting a cleaning tool which comprises a cylindrical back portion having an axis and a receiving opening; and a front portion having a generally semicylindrical shape, with an axis and a flat planar bottom surface, and two protuberances having a generally triangular prism shape; and selecting a removable covering; and installing said removable covering on said cleaning tool;

wherein said front portion's flat bottom surface is partially covered with hook material; and wherein said two protuberances share the flat planar bottom surface of the remainder of the said front portion, and extend diagonally forward and outward from either side of the said front portion; and wherein said removable covering covers at least the said hook material of the cleaning tool's bottom surface; and wherein the said axis of the said cylindrical back portion of the cleaning tool, as it extends upward, forms an angle with the said front portion's axis, as the front portion's axis extends behind the tool, and the said angle is between 25 and 55 degrees.

16. The method of assembling a painting and cleaning multi-tool of claim 15, further comprising the steps of:

selecting a pole which has a first end and a second end, wherein said receiving opening of said cleaning tool is configured to removably attach to the first end of said pole using hand pressure; and installing said pole into said receiving opening.

17. The method of assembling a painting and cleaning multi-tool of claim 15, further comprising the steps of:

selecting a tubular adaptor with a first end, a second end, an inner surface and an outer surface; and installing said adaptor's first end into said receiving opening; and installing said pole's first end into said adaptor's second end;

wherein said adaptor's first end is configured to removably fit inside the said receiving opening, and said adaptor's second end is configured to firmly receive the said pole's first end; and wherein said cleaning tool, adaptor and pole are configured to removably attach together using hand pressure; and wherein the said inner surface of said adaptor comprises uniformly spaced axial ridges which extend from said adaptor's said first end to its said second end; and wherein the said adaptor's first and second ends each have an inner diameter and an outer diameter; and wherein the said outer diameters of the adaptor's first and second ends are equal; and wherein the said inner diameter of the adaptor's first end is greater than the said inner diameter of the adaptor's second end, such that the inner surface of the adaptor is tapered.

18. The method of assembling a painting and cleaning multi-tool of claim 16, further comprising the steps of:

selecting an additional tool or painting implement which is configured to be attached to said pole's second end; and installing said additional tool or painting implement onto said pole's second end;

wherein either of the said cleaning tool and said painting implement or additional tool can be usefully employed by reversing the orientation of said painting and cleaning assembly, without further adjustment or modification to said assembly.

19. The method of assembling a painting and cleaning multi-tool of claim 17, further comprising the steps of:

selecting an additional tool or painting implement which is configured to be attached to said pole's second end; and installing said additional tool or painting implement onto said pole's second end;

wherein either of the said cleaning tool and said painting implement or additional tool can be usefully employed by reversing the orientation of said painting and cleaning assembly, without further adjustment or modification to said assembly.

20. The method of assembling a painting and cleaning multi-tool of claim 15, wherein said angle is 35 degrees.

* * * * *